US005318199A

United States Patent [19]

Brashears

[11] Patent Number: 5,318,199

[45] Date of Patent: Jun. 7, 1994

[54] GATE SEAL FOR ASPHALT STORAGE SILO

[75] Inventor: David F. Brashears, Belle Isle, Fla.

[73] Assignee: Gencor Industries, Inc., Orlando, Fla.

[21] Appl. No.: 830,896

[22] Filed: Feb. 4, 1992

[51] Int. Cl.[5] ..... B67D 5/62

[52] U.S. Cl. ..... 222/146.2; 222/542; 222/559

[58] Field of Search ..... 222/146.2, 185, 190, 222/462, 542, 559, 561; 414/287; 277/34, 34.6; 220/345; 110/105; 126/343.5 A

[56] References Cited

U.S. PATENT DOCUMENTS

| | | | |
|---|---|---|---|
| 3,301,441 | 1/1967 | Werner et al. | 414/287 |
| 3,305,138 | 2/1967 | Plumb | 222/185 |
| 3,348,739 | 10/1967 | Brock | 126/343.5 A |
| 3,532,252 | 10/1970 | Brock | 222/52 |
| 3,820,687 | 6/1974 | Brock | 222/53 |
| 3,853,305 | 12/1974 | Mize | 259/179 |
| 3,946,772 | 3/1976 | Mize | 141/98 |
| 3,949,907 | 4/1976 | Mize | 222/188 |
| 4,249,679 | 2/1981 | Dillman | 222/561 |
| 4,284,203 | 8/1981 | Mize | 220/345 |
| 4,428,504 | 1/1984 | Bassett et al. | 222/559 |
| 4,785,966 | 11/1988 | Waltke | 222/559 |

FOREIGN PATENT DOCUMENTS

| | | | |
|---|---|---|---|
| 886273 | 8/1953 | Fed. Rep. of Germany | 222/146.2 |
| 2738353 | 3/1978 | Fed. Rep. of Germany | . |
| 2511348 | 2/1983 | France | . |

*Primary Examiner*—Andres Kashnikow
*Assistant Examiner*—Philippe Derakshani
*Attorney, Agent, or Firm*—Nixon & Vanderhye

[57] ABSTRACT

The storage silo has a frustoconical discharge chute terminating in an annular outlet member having an inflatable bladder about its margin. A gate is movable horizontally and, when in the vicinity of the opening near its closing position, movable both horizontally and vertically into engagement with the margin of the cylindrical wall member. The bladder is then inflated to engage the gate sealing between the outlet and the gate. To open the outlet, the bladder is deflated to a location above the margins of the opening whereby the gate may be moved vertically downwardly and horizontally away from the opening to discharge material from the silo.

1 Claim, 4 Drawing Sheets

GATE SEAL FOR ASPHALT STORAGE SILO

BACKGROUND AND SUMMARY OF THE INVENTION

The present invention relates generally to a gate and a seal for the gate about the outlet of a material storage container and particularly relates to a gate seal for selectively opening and closing the outlet of an asphalt storage silo.

Storage silos are frequently used for storing various types of materials. Typically, such silos have conveyors for conveying the material from ground level to adjacent the top of the silo and depositing the material in the silo. An outlet is disposed adjacent the bottom of the silo and which outlet is typically situated above a drive-through material transfer station. Thus, material from the silo may be discharged through the outlet directly into a truck or other conveyance. As a specific example, storage silos are frequently used as surge containers for storing asphalt mix in the asphalt paving industry. Frequently, because of weather or other conditions, hot asphalt mix must be stored for later use. As a condition for storing the hot asphalt mix, the mix must be maintained at an elevated temperature in order to preclude the mix from setting up. Additionally, the mix must be stored in a sealed container to avoid oxidation which causes deterioration of the asphalt mix. One of the particular problems associated with storing hot asphalt mix is to provide an effective seal about the outlet opening of the silo.

One currently used seal for this purpose comprises a pair of concentric cylinders against which a gate is driven with a trolley system and wedges. The gate is closed about the silo outlet and grease is pumped into the annulus between the cylinders. While this system has worked satisfactorily, it is necessary for the gate to drive hard against the cylinders and to maintain the cavity between the cylinders clear so that the grease can fill the cavity. Unfortunately, debris becomes packed in this area, preventing the formation of a tight seal between the gate and the cylinders and oftentimes precluding the grease from filling the cavity to make the seal.

Other sealing systems for asphalt mixes are also known. For example, fluid seals, such as illustrated in U.S. Pat. Nos. 3,532,252 and 4,284,203 have been used. Also, an inflatable seal has been used, for example, as illustrated in U.S. Pat. No. 3,820,687. In that patent, the sliding action is strictly horizontal, causing the seal to abrade and generally wear.

According to the present invention, there is provided a gate and seal for a storage container which minimizes or eliminates the foregoing and other problems associated with the prior gates and seals for storage containers and provides a novel and improved gate and seal construction having various advantages in construction, mode of operation and use in comparison therewith. Particularly, the present invention includes a storage container, for example, a silo for containing hot asphalt mix having an outlet adjacent its lower end. The outlet is preferably in cylindrical form comprising the lower end of a frustoconical discharge chute. About the outside of the outlet is an annular chamber containing heating oil for maintaining the asphalt mix in the chute and outlet at an elevated temperature sufficient such that the material does not set up within the silo. Additionally, a second annular chamber is also disposed about the annular outlet opening and comprises an air chamber for feeding air to an underlying inflatable bladder. The bladder lies just above the plane containing the edge of the opening and, when inflated, may project below the edge.

The gate portion of the gate and seal combination of the present-invention includes a flat plate forming a gate for sealing against the cylindrical edge or margin of the outlet. The gate is mounted on a structural frame and has pairs of side rollers for rolling the frame and gate along a pair of spaced tracks forming part of the silo. The tracks are spaced relative to the margin of the outlet opening of the silo such that the gate may pass below the outlet margins in initial spaced relation thereto. The tracks have cam surfaces, e.g., wedges, which permit the frame and gate when the rollers engage along the inclined surfaces of the wedges to not only translate in a horizontal direction but also to move in a vertical direction. That is, the combination of the wedges and rollers permit the gate to move upwardly, i.e., in a direction opposite to the direction of the material flowing through the outlet when the gate lies in an open position. Because the gate engages the annular margin of the cylindrical opening, there is little danger of debris being caught between the gate and the annular margin. Also, the bladder does not engage the gate until the gate is seated against the cylindrical edge and movement of the gate has stopped. This precludes substantial wear and abrasion of the bladder. Further, because the bladder lies outside of the annular outlet and is inflatable, any debris caught on the plate below the bladder does not substantially affect the seal formed between the gate and the bladder. That is, the inflatable seal substantially seals about any such debris if it cannot seal directly against the top surface of the plate.

In a preferred embodiment according to the present invention, there is provided apparatus for selectively opening and closing a material flow outlet for a material storage container comprising means forming part of the storage container, including a peripheral margin defining the material flow outlet, a gate movable between open and closed positions respectively spaced from the outlet for opening the outlet and disposed about the margin for closing the outlet and an inflatable seal disposed about the peripheral margin of the outlet. Means are provided for inflating the seal for engagement with the gate about the peripheral margin of the outlet for substantially sealing the outlet when the gate lies in its closed position, the outlet enabling flow of material therethrough in a first direction when the gate is spaced from the outlet and in the gate open position. Also provided are means for mounting the gate for movement in a direction opposite the first direction and in a second direction generally normal to the first direction when the gate is moved from its open position into its closed position and means for moving the gate between the open and closed positions.

In a further preferred embodiment according to the present invention, there is provided apparatus for selectively opening and closing an outlet for discharging hot asphalt mix from a storage silo comprising means forming part of the storage silo including a peripheral margin defining the asphalt mix outlet, a gate movable between open and closed positions respectively spaced from the outlet for opening the outlet and disposed about the margin for closing the outlet and an inflatable seal disposed about the peripheral margin of the outlet. Means are provided for inflating the seal for engagement with the gate about the peripheral margin of the outlet for substantially sealing the outlet when the gate lies in its closed position, the outlet enabling flow of hot asphalt mix therethrough in a first direction when the gate is spaced from the outlet and in the gate open position. Means are disposed about the margin of the outlet for heating the hot asphalt mix within the outlet when the outlet is closed by the gate, with means for mounting the gate for movement in a direction opposite the first direction and in a second direction generally normal to the first direction when the gate is moved from its open position into its closed position and means for moving the gate between the open and closed positions.

Accordingly, it is a primary object of the present invention to provide a novel and improved gate and seal for a material storage container and particularly a gate and seal for a hot asphalt mix storage silo wherein the hot asphalt mix in the container is effectively sealed from oxidation.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
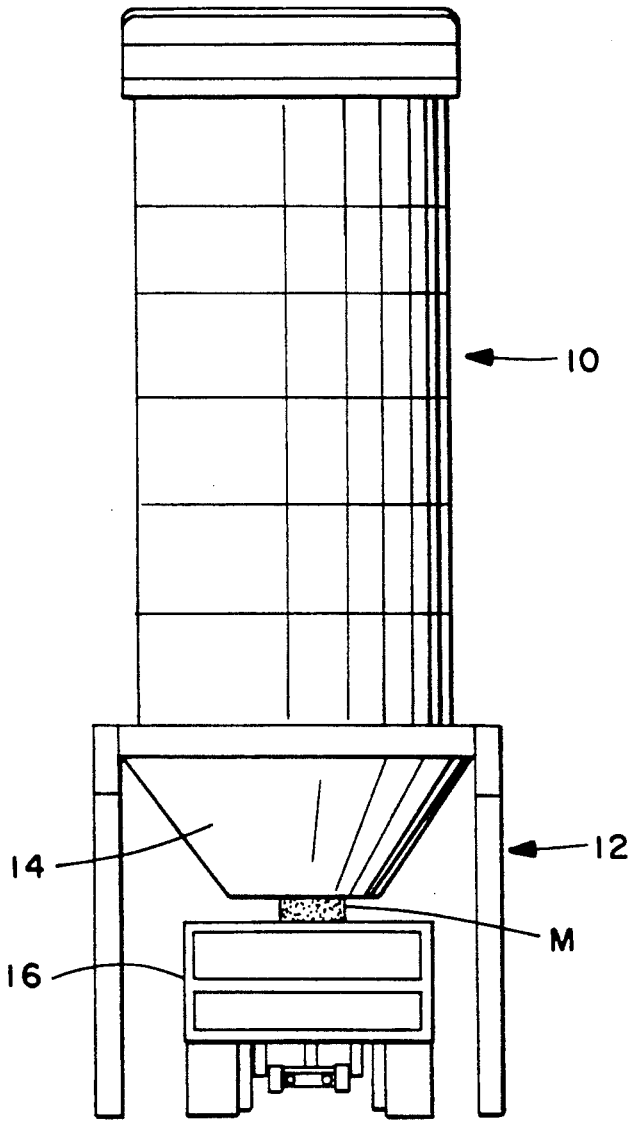
FIG. 1 is a side elevational view of a storage silo incorporating a gate and seal according to the present invention and illustrating a truck disposed below the outlet opening of the silo.

Referring now to the drawings, particularly to FIG. 1, there is illustrated a storage container, for example, a storage silo for containing hot asphalt mix, the silo being generally designated 10. Silo 10 is elevated by a supporting frame, generally designated 12, such that its outlet 14 is elevated, enabling a truck 16 or other conveyance to be located below the outlet for receiving the material M discharged from silo 10. Consequently, truck 16 may be driven within support frame 12 below outlet 14 for receiving the material when the outlet is opened. The silo may be provided with the material by conveyors, not shown, which convey the material to an inlet opening, similarly not shown, adjacent the upper end of silo 10.

Figure 2:
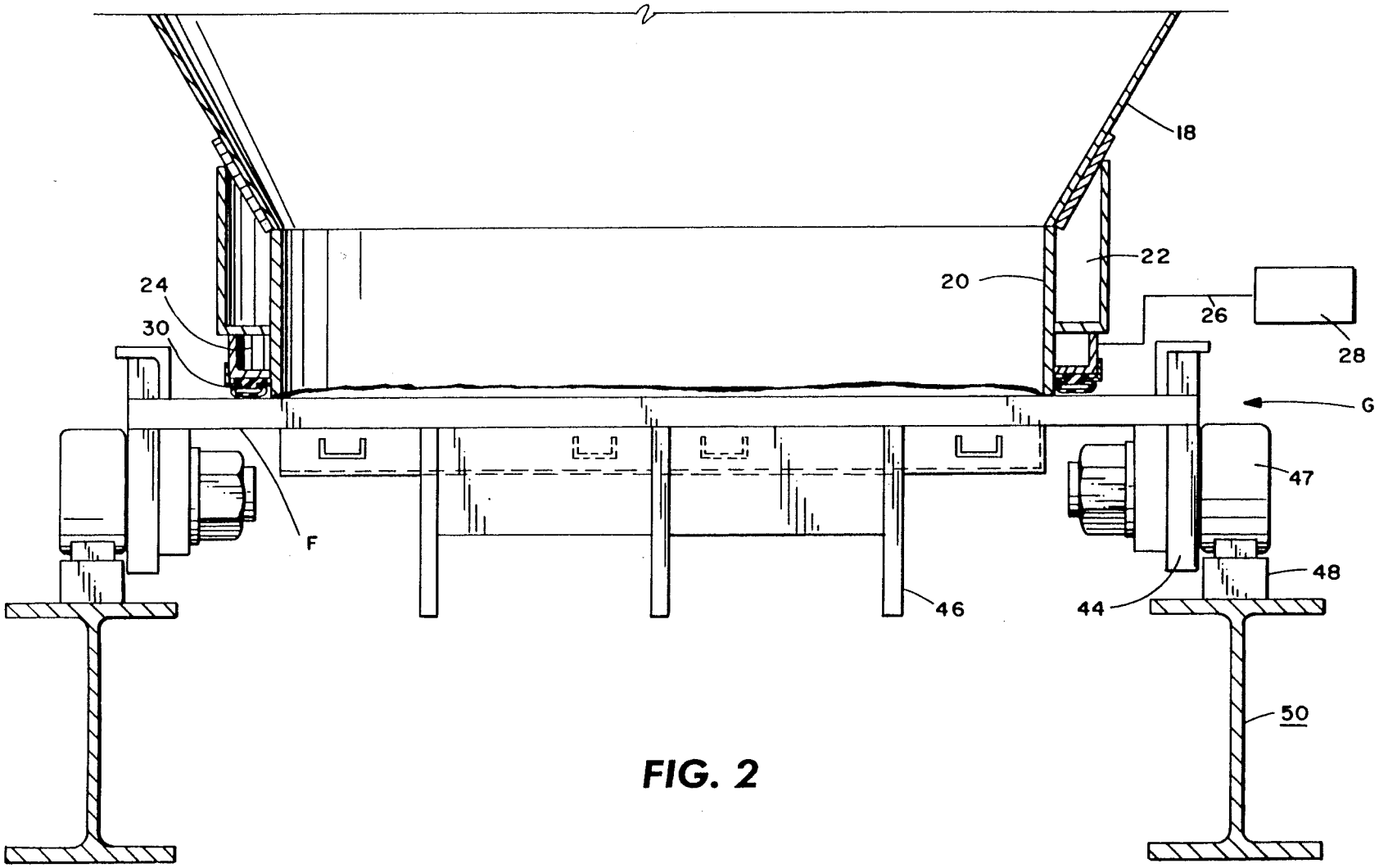
FIG. 2 is an enlarged cross-sectional view of the outlet of the silo and illustrating the gate and seal therefor according to the present invention.

Referring to FIG. 2, outlet 14 includes a discharge chute which may comprise various circular or rectilinear cross-sectional shapes but which preferably has a frustoconical shape, including conical side walls 18 terminating at their lower end in a cylindrical outlet wall member 20. Disposed about wall 20 is an annular chamber 22 for containing oil which is heated, by means not shown, for maintaining the asphalt mix adjacent outlet 14 at an elevated temperature to preclude the material from setting. Below annular chamber 22, there is provided a second annular chamber 24 coupled via line 26 to a source of gas or air under pressure, for example, a compressor 28. In this manner, annular chamber 24 may be selectively pressurized. Disposed below annular chamber 24 is an inflatable bladder 30 which forms the gate seal, as described hereinafter.

Figure 4:
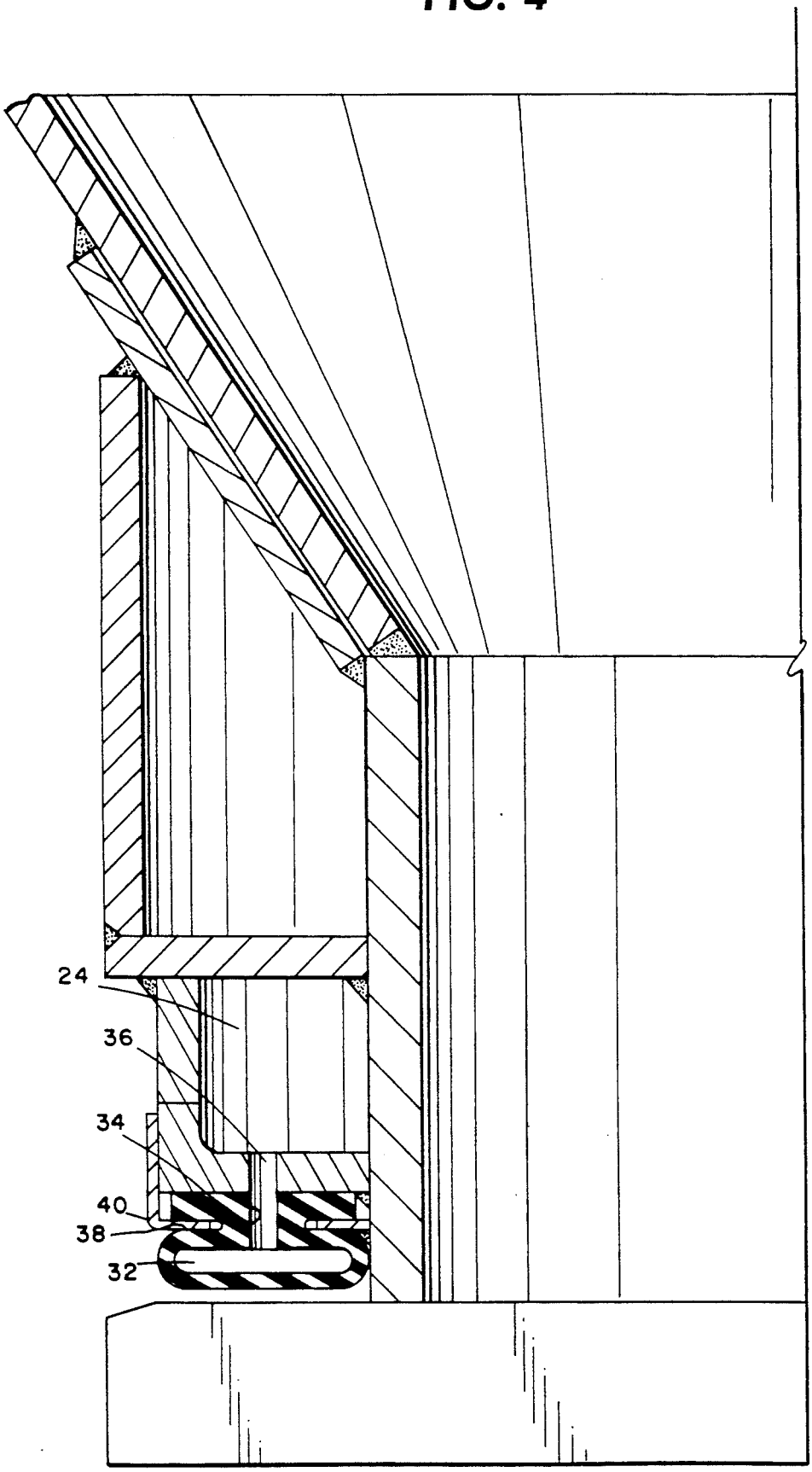
FIG. 4 is an enlarged fragmentary cross-sectional view illustrating the lower end of the outlet including the inflatable bladder poised for sealing engagement with the gate about the outlet opening.

Bladder 30, as illustrated in FIG. 4, may comprise a closed annular chamber 32 which can be generally cylindrical in cross-section when fully inflated. The chamber 32 lies in communication through an opening 34 in registry with an opening 36 in chamber 24 whereby the bladder can be inflated and deflated by on/off operation of compressor 28 or by compressor 28 in conjunction with a vent valve, not shown. Bladder 30 preferably has a base portion 38 along one side, defining annular grooves for receiving brackets 40 for securing the bladder to the outlet along the underside of the chamber 24. In the deflated condition of bladder 30, its lower margin lies above the lower edge of cylindrical wall member 20 to prevent wear and abrasion of the bladder upon movement of the gate as described hereinafter.

Figure 3:
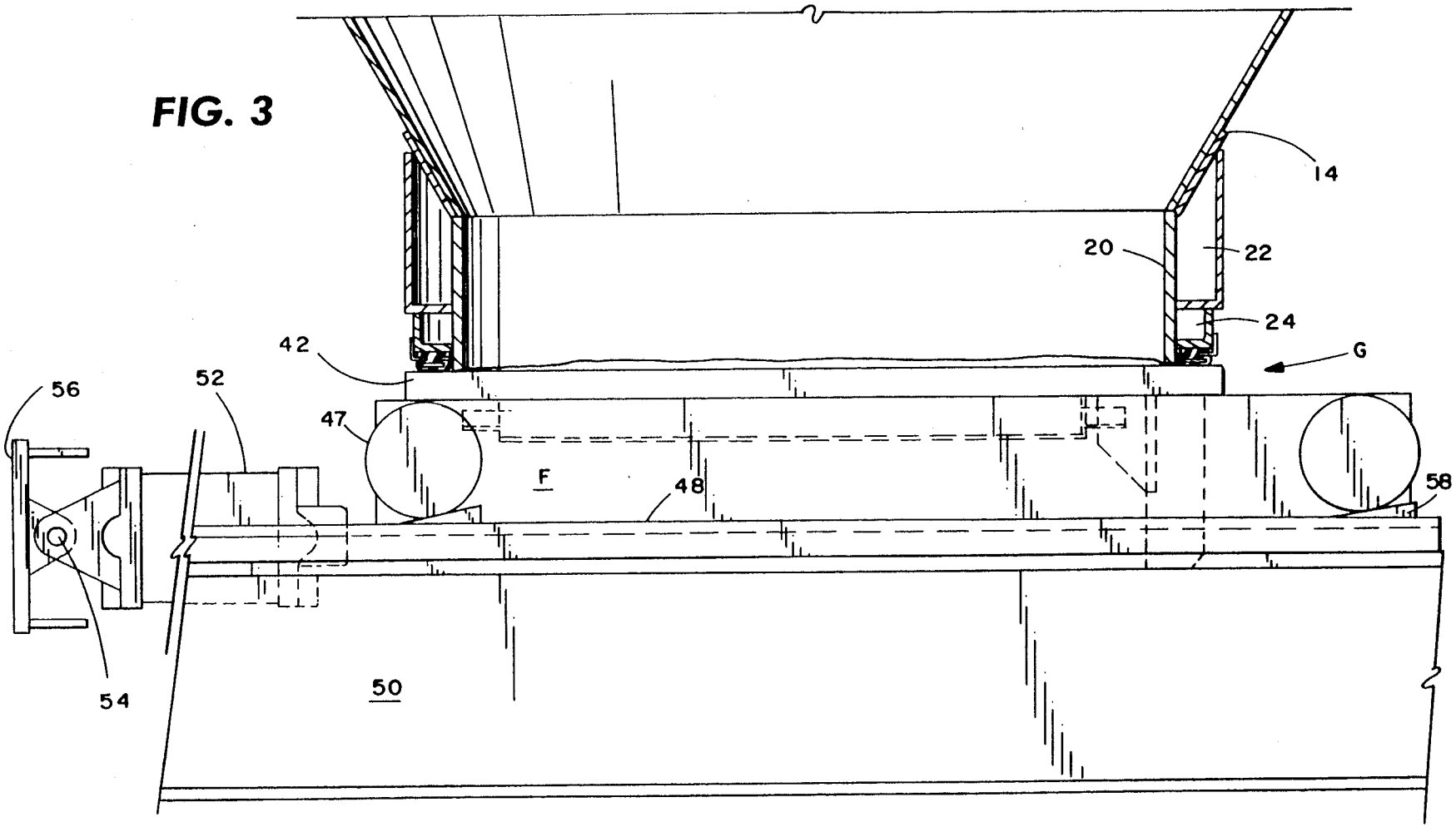
FIG. 3 is a fragmentary side elevational view with parts in cross-section of the outlet, gate and seal illustrated in FIG. 2 looking from left to right in FIG. 2.

Referring now to FIGS. 2 and 3, gate G includes a flat plate 42, preferably rectangular and formed of metal, which is mounted on a frame F, including side frame members 44 and intermediate frame members 46. At longitudinally spaced locations along side frame members 44, there are disposed a pair of rollers 47 whereby the frame can be guided for horizontal translational movement along a pair of laterally spaced tracks 48. Tracks 48 are mounted on silo support beams 50. With this configuration, it will be appreciated that the gate G may be translated along tracks 48 between positions opening and closing the outlet 14.

To move the frame between outlet-open and outlet-closed positions, there is provided an air cylinder 52. One end of cylinder 52 is secured by a pivot hinge 54 to a support 56. The piston, not shown, of the cylinder 52 is secured to frame F adjacent its forwardmost portion whereby extension and retraction of the piston causes the frame to move horizontally along tracks 48 between closed and opened positions, respectively, of gate G relative to the opening through outlet 14.

To ensure that gate G closes outlet 14, particularly by engaging the peripheral margin of the annular wall member 20, cams in the form of wedges 58 are disposed along tracks 48 to elevate the frame F and hence gate G, once frame F is moved into a near closed position, i.e., in registry with and below wall member 20. Thus, it will be appreciated that frame F and gate G may be displaced for translational or horizontal movement before rollers 46 engage wedges 58. Once the rollers engage wedges 58, the frame F and gate G have both vertical and horizontal components of movement whereby gate G may be positioned in abutting engagement with the peripheral margin of wall member 20.

It will be appreciated that the air cylinder 52 may be actuated to close outlet 14 by moving the gate G initially horizontally and then both horizontally and vertically along ramps 38 for engagement with wall member 20. When the plate 42 is engaged with the wall member 20, the bladder 30 is in a deflated state, spaced from plate 42 and may be inflated by operating compressor 28. Upon inflation, bladder 32 expands downwardly into engagement against the upper surface of plate 42, forming a seal about the opening defined by the wall member 20 and between outlet 14 and gate G. Consequently, any debris caught between plate 42 and the peripheral margin of wall member 20 does not affect the seal between the bladder and the gate. Additionally, any debris caught between the bladder and the gate will have minimal or no effect on the seal therebetween because the bladder will substantially envelop or seal about and against the debris whereby the bladder may form the seal between the gate and the outlet. Note that no abrasion of and wearing action on the bladder occurs upon movement of the gate G into engagement with the wall member 20 because the bladder is spaced back from the margin of wall member 20 and need not be inflated for engagement with plate 42 until movement of plate 42 has stopped.

Similarly, upon retraction of the piston of air cylinder 52 to open outlet 14, the gate G is simultaneously displaced downwardly and horizontally away from wall member 20. Before such displacement, however, bladder 30 is preferably deflated, for example, by venting it using suitable control valving responsive to the opening of the outlet such that the bladder is spaced above plate 42 before movement of gate G. Thus, subsequent movement of gate G vertically and horizontally to open outlet 14 does not wear or abrade the bladder.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for selectively opening and closing an outlet for discharging hot asphalt mix from a storage silo comprising:

a hot asphalt mix downwardly convergent outlet chute forming part of the storage silo and including upper and lower ends and a peripheral margin at the lower reduced end of the chute defining the asphalt mix outlet;

a gate movable between open and closed positions respectively spaced from said outlet for opening said outlet and disposed about said margin for closing said outlet; pg,16 an inflatable seal disposed about the peripheral margin of said outlet, said seal, when deflated, being spaced back from the peripheral margin of said outlet on a side thereof opposite said gate;

means for inflating said seal for engagement with said gate about the peripheral margin of said outlet for substantially sealing said outlet when said gate lies in its closed position;

said outlet enabling flow of hot asphalt mix therethrough in a first direction when said gate is spaced from said outlet and in said gate open position;

means disposed about the margin of said outlet adjacent the lower end of said chute for heating the hot asphalt mix within said outlet when said outlet is closed by said gate;

means for mounting said gate for movement in a direction opposite said first direction and in a second direction generally normal to said first direction when said gate is moved from its open position into its closed position;

means for moving said gate between said open and closed positions;

said means for inflating said seal including an annular chamber about said lower end of said outlet chute, said inflatable seal being disposed below said annular chamber and in communication therewith through an opening in the annular chamber, said heating means comprising an annular chamber disposed about the lower end of said outlet chute above the annular chamber for inflating the seal.

* * * * *